US005721061A

United States Patent [19]

Jackson et al.

[11] Patent Number: 5,721,061

[45] Date of Patent: Feb. 24, 1998

[54] OXIDATION-RESISTANT COATING FOR NIOBIUM-BASE ALLOYS

[75] Inventors: Melvin Robert Jackson, Niskayuna; Ann Melinda Ritter, Albany, both of N.Y.

[73] Assignee: General Electric Company, Schenectady, N.Y.

[21] Appl. No.: 751,065

[22] Filed: Nov. 15, 1996

[51] Int. Cl.[6] ..... B32B 15/00

[52] U.S. Cl. ..... 428/641; 420/425; 420/426; 420/578; 427/250; 427/372.2; 427/376.2; 427/376.4; 427/376.6; 427/376.7; 427/376.8; 427/405; 427/419.7; 428/660; 428/662

[58] Field of Search ..... 428/641, 662, 428/660; 420/425, 426, 578; 427/250, 372.2, 376.2, 376.4, 376.6, 376.7, 376.8, 404, 405, 419.7

[56] References Cited

U.S. PATENT DOCUMENTS

| | | | |
|---|---|---|---|
| 3,864,093 | 2/1975 | Wolfa | 29/195 |
| 4,155,753 | 5/1979 | Ryabchikov et al. | 75/10 R |
| 4,369,233 | 1/1983 | Van Schaik | 428/641 |
| 4,904,546 | 2/1990 | Jackson | 428/662 |
| 4,942,732 | 7/1990 | Priceman | 428/641 |
| 5,264,293 | 11/1993 | Benz et al. | 428/662 |
| 5,273,831 | 12/1993 | Jackson et al. | 428/662 |
| 5,366,565 | 11/1994 | Jackson | 420/426 |
| 5,427,735 | 6/1995 | Ritter et al. | 419/47 |
| 5,626,462 | 5/1997 | Jackson et al. | 416/97 R |

OTHER PUBLICATIONS

S. Priceman et al., "Fused Slurry Silicide Coatings for the Elevated Temperature Oxidation of Columbium Alloys", Refractory Metals and Alloys IV–TMS Conference Proceedings, French Lick, IN, Oct. 3–5, 1965 (1966), pp. 959–982.

*Primary Examiner*—Archene Turner

*Attorney, Agent, or Firm*—Ernest G. Cusick; William H. Pittman

[57] ABSTRACT

Si-Fe-Cr base coating alloys that significantly promote the oxidation resistance of niobium-base alloys and intermetallic materials when deposited and reaction bonded to the niobium-base material. The coating alloys are deposited and then reaction bonded to a niobium-base material to yield an oxidation-resistant coating comprising an interaction layer containing at least one oxidation-resistant Si-Fe-Nb-Cr intermetallic phase.

20 Claims, No Drawings

OXIDATION-RESISTANT COATING FOR NIOBIUM-BASE ALLOYS

BACKGROUND OF THE INVENTION

The present invention relates to oxidation-resistant coatings for niobium-base materials used in high temperature applications. More particularly, this invention relates to Si-Fe-Cr fusion coatings for niobium-base alloys and niobium-base intermetallic composite materials, the Si-Fe-Cr fusion coatings forming oxidation-resistant Si-Fe-Nb-Cr intermetallic phases within an interaction layer that protects the underlying niobium-base material from oxidation.

Various high temperature materials have been developed for use in gas turbine engines. While cobalt-base and nickel-base superalloys have found wide use in the manufacture of gas turbine engine components such as nozzles, combustors, and turbine vanes and blades, certain operating temperatures or conditions favor the use of niobium-base alloys, such as the exhaust section of a gas turbine engine. However, niobium-base alloys may not exhibit a sufficient level of oxidation resistance as a result of insufficient or inadequate oxide-forming alloying constituents. As such, niobium-base alloys typically require an oxidation-resistant coating, particularly if operating temperatures will exceed about 800° C.

Commercially-available fusion coatings based on, in weight percent, Si-20Fe-20Cr have been proven effective in promoting the oxidation resistance of high temperature components formed from niobium-base alloys. However, the fusion (reaction bonding) process must be conducted at about 1400° C.; at which considerable grain-coarsening of the niobium-base alloy tends to occur, together with a general degradation of mechanical properties, particularly resistance to fracture.

In addition to the above, the Si-20Fe-20Cr alloy has not proven to be suitable as an oxidation-resistant coating for niobium-base intermetallic alloys. Such a coating would be particularly desirable for niobium-base intermetallic alloys that form engine components subjected to service at elevated temperatures, e.g., up to about 1370° C. An example is Nb-Ti base composites having a strength-promoting silicide intermetallic phase. However, when coated with the prior art Si-20Fe-20Cr alloy, such composites have exhibited resistance to oxidation at 1200° C. for only about 100 hours.

Accordingly, it would be desirable if an oxidation-resistant coating were available that entailed processing temperatures below 1400° C. It would be further desirable if an oxidation-resistant coating were available that was suitable for protecting niobium-base intermetallic alloys and niobium-base intermetallic composite materials.

SUMMARY OF THE INVENTION

It is an object of this invention to provide a class of oxidation-resistant coating materials for components formed from niobium-base materials.

It is a further object of this invention that such coating materials include Si-Fe-Cr alloys that can be processed at temperatures below 1400° C.

It is another object of this invention that such coating materials include Si-Fe-Cr alloys that are suitable for use with niobium-base intermetallic materials.

It is yet another object of this invention that such coating materials are processed to yield intermetallic phases that exhibit considerable resistance to oxidation at temperatures of at least 1200° C.

In accordance with a preferred embodiment of this invention, these and other objects and advantages are accomplished as follows.

According to the present invention, there are provided Si-Fe-Cr coating alloys that significantly promote the oxidation resistance of a niobium-containing substrate material, such as niobium-base alloys and niobium-base intermetallics and composites, when deposited and reaction bonded to such substrates. The coating alloys of this invention are generally alloyed and processed according to the composition of the niobium-containing material.

For a niobium-base intermetallic composite material, processing generally entails the steps of depositing a suitable Si-Fe-Cr alloy on the surface of the intermetallic material, followed by reaction or fusion bonding by heat treating at a temperature of about 1250° C. to about 1400° C. The composition of the Si-Fe-Cr alloy, which has a relatively high iron and chromium content, is such that the heat treating step yields an oxidation-resistant coating comprising an outer layer and an interaction layer between the outer layer and the intermetallic material. Both the outer and interaction layers develop at least one oxidation-resistant Si-Fe-Nb-Cr intermetallic phase. According to one embodiment of this invention, the Si-Fe-Cr alloy consists essentially of, in weight percent, about 26 to about 32 iron and about 24 to about 30 chromium, with the balance being silicon and incidental impurities. Heat treatment of this alloy yields several different oxidation-resistant intermetallic phases in each of the outer and interaction layers.

Alternatively, a coating can be deposited to have a composition closer to one of the oxidation-resistant intermetallic phases produced during fusion bonding of the Si-Fe-Or alloy. According to this aspect of the invention, a suitable coating alloy consists essentially of, in atomic percent, about 23 iron, about 19 niobium, about 9 titanium, about 1.5 chromium and about 0.5 hafnium, with the balance being essentially silicon, corresponding in weight percent to about 24 to about 28 iron, about 34 to about 38 niobium, about 7 to about 11 titanium, about 0.5 to about 4 chromium, and up to about 3 hafnium, the balance essentially silicon.

For a niobium-base alloy, processing generally entails the steps of depositing a Si-Fe-Or alloy on the niobium-base alloy substrate, followed by heat treating at a temperature of at least about 1200° C., preferably not more than about 1350° C. The composition of the Si-Fe-Cr alloy is such that the heat treating step yields an interaction layer containing at least one oxidation-resistant Si-Fe-Nb intermetallic phase, with the remaining outer portion of the Si-Fe-Cr alloy either spalling or being otherwise removed to expose the interaction layer. Suitable Si-Fe-Cr alloys consist essentially of, in weight percent, about 16 to about 25 iron, about 16 to about 24 chromium, and about 7 to about 20 aluminum, with the balance being silicon and incidental impurities. The interaction layer tends to be characterized by two distinct layers, a first of which being characterized by Si(Nb,Ti,Fe) and Si(Nb,Ti,Fe,Or) intermetallic phases, while the second layer is characterized by a M3Si2 phase, where "M" is niobium, titanium, iron and/or chromium.

The intermetallic phases formed by the coatings and process of this invention have been shown to impart considerable oxidation resistance to niobium-containing materials subjected to oxidizing conditions, such as those conditions present in the exhaust section of a gas turbine engine. Importantly, the oxidation-resistant coating alloys suitable for niobium-base alloys can be reaction bonded at temperatures well below those temperatures at which grain growth becomes prevalent, e.g., about 1400° C. Furthermore, this invention provides oxidation-resistant coating alloys suitable for the unique circumstances of niobium-base intermetallic composite materials.

Other objects and advantages of this invention will be better appreciated from the following detailed description.

DETAILED DESCRIPTION PREFERRED EMBODIMENTS

The present invention provides Si-Fe-Cr alloys suitable as oxidation-resistant coatings for niobium-containing materials, including niobium-base alloys, intermetallics and intermetallic composite materials. The coatings of this invention are particularly adapted for components that must operate at elevated temperatures of 1200° C. or more, including such components as exhaust components of a gas turbine engine, though it is foreseeable that this invention could be applied to other gas turbine engine components, including high and low pressure turbine nozzles and blades, shrouds, combustor liners and augmentor hardware. It is also within the scope of this invention that the coatings could be used in numerous other applications in which a niobium-containing material is subjected to an oxidizing atmosphere.

The oxidation-resistant coatings of this invention are generally Si-Fe-Cr alloys with possible alloying additions that yield the desired oxidation resistance through the formation of intermetallic phases. According to this invention, a base composition for a coating that is suitable for a niobium-base intermetallic material is, in weight percent, about 26 to about 32 percent iron and about 24 to about 30 percent chromium, with the balance being silicon and incidental impurities.

In one example, a powder of an Si-29Fe-27Cr (weight percent) alloy was air plasma sprayed (APS) onto a niobium-base silicide intermetallic composite specimen having the nominal composition, in atomic percent, of 36Nb-33.6Ti-1.5Al-1.5Cr-25.9Si-1.5Hf. The thickness of the resulting coating was approximately 125 micrometers. Following deposition, the coated composite specimen underwent vacuum heat treatment at about 1400° C. for a period of about one hour to reaction bond the coating to the composite. The specimen was then oxidized by being subjected to air at a temperature of about 1200° C. for a duration of about five hundred hours. An examination of the specimen revealed a weight gain (attributable to oxidation) of only about 1.2 milligrams per square centimeter of coating surface.

Metallographic examination of the specimen showed oxidation of an outer region of the coating, but very limited or no oxidation of an interaction zone formed between the outer region and the underlying composite substrate. Analysis by electron microprobe indicated that two unoxidized silicide phases were present in the outer region of the coating. A first of these phases had a nominal composition, in atomic percent, of Si-23.7Fe-23.1Nb-9.0Ti-1.5Cr-0.5Hf, while the second phase had a nominal composition, in atomic percent, of Si-24.1Ti-21.9Nb-6.8Fe-6.4Cr-0.7Hf. Likewise, the interaction zone contained two unoxidized silicide phases, a first of which had a nominal composition, in atomic percent, of Si-20.7Nb-18.2Fe-16.6Ti-3.7Cr-0.4Hf, while the second phase had a nominal composition, in atomic percent, of Si-31.5Ti-18.1 Nb-6.7Cr-5.0Fe-0.5Hf.

From this analysis, it was recognized that each of these phases could be individually deposited on a niobium-base material to form an oxidation-resistant intermetallic coating without undergoing a fusion bond heat treatment. For example, a suitable coating composition would be, in atomic percent, about 47Si-23Fe-19Nb-9Ti-1.5Cr-0.5Hf. Corresponding weight percentages for the unoxidized silicide phases identified above, and therefore suitable oxidation-resistant intermetallic coatings, are as follows.

| | A | B | C | D |
|---|---|---|---|---|
| Fe | 24–28 | 6–10 | 18–22 | 4–8 |
| Cr | 0.5–4 | 4–8 | 2–6 | 5–9 |
| Nb | 34–38 | 38–42 | 36–40 | 31–35 |
| Ti | 7–11 | 20–24 | 14–18 | 29–31 |
| Hf | 0–3 | 0–3 | 0–3 | 0–3 |
| Si | balance | balance | balance | balance |

For niobium-base alloys other than intermetallics and composites, the oxidation-resistant coatings of this invention are also generally Si-Fe-Cr alloys, but with selective alloying additions of aluminum to yield one or more desirable intermetallic phases. A base composition for such a coating is, in weight percent, about 16 to about 25 percent iron, about 16 to about 24 percent chromium, and about 7 to about 20 percent aluminum, with the balance being silicon and incidental impurities.

In one example, powder mixtures of two distinct alloy powders were air plasma sprayed onto Nb-Ti alloy specimens having the nominal composition, in weight percent, of Nb-24.65Ti-1.85Al-3.57Cr-12.25Hf-3.5V-0.63Zr. The compositions of the alloy powders, in weight percent, were as follows:

| POWDER | Si | Fe | Cr | Al |
|---|---|---|---|---|
| A | 60 | 20 | 20 | — |
| B | 44 | 29 | 27 | — |
| C | 11.6 | — | — | 88.4 |

A first Nb-Ti alloy specimen was coated with a powder mixture composed of about 90 weight percent of Powder A and about 10 weight percent of Powder C, yielding a coating composition of, in weight percent, about 55.2 silicon, about 18.0 iron, about 18.0 chromium, and about 8.8 aluminum. A second Nb-Ti alloy specimen was coated with a powder mixture composed of about 80 weight percent of Powder B and about 20 weight percent of Powder C, yielding a coating composition of, in weight percent, about 37.5 silicon, about 23.2 iron, about 21.6 chromium, and about 17.7 aluminum. The thickness of each of the resulting coatings was approximately 125 micrometers. Following deposition, the coatings were reaction bonded to the specimens by a vacuum heat treatment, during which the first and second coated specimens underwent heat treatment at about 1200° C. and about 1325° C., respectively, for a period of about one hour. Each specimen was then oxidized in air at a temperature of about 1200° C. for a duration of about 150 hours.

A macroscopic examination of the specimens revealed that an outer layer of each coating had flaked off during heat treatment or thereafter, i.e., during oxidation. However, weight gain/area from oxidation following spallation of the outer layer was minimal. Metallographic examination of the specimens showed that an oxidation-resistant interaction zone had formed in the coating material remaining on the specimens. Analysis by electron microprobe indicated that the interaction zone was characterized by two regions. That portion of the interaction zone nearest the spalled coating was a mixture of two unoxidized MSi intermetallic phases, while that portion of the interaction zone nearest the Nb-Ti alloy substrate was primarily M3Si2 intermetallic, where "M" is niobium, titanium, iron and chromium. Of the two MSi phases, one was rich in niobium, titanium and iron (i.e., (Nb,Ti,Fe)Si) with some chromium, while the second was rich in niobium and titanium with some iron and chromium (i.e., (Nb,Ti,Fe,Cr)Si).

From the above analysis, it was concluded that the interaction layer provides the desired oxidation resistance, and that the outer layer could be removed as a result of heat treatment, or could be removed by other means following heat treatment. In addition, it was concluded that each of the intermetallic phases could be individually deposited on a Nb-Ti alloy to form an oxidation-resistant coating. For example, based on the above, a suitable coating composition would be, in atomic percent, about 40Si-15Fe-15Nb-20Ti-10 Cr, with a suitable compositional range being, in weight percent, about 15 to about 19 iron, about 9 to about 13 chromium, about 27 to about 31 niobium, and about 18 to about 22 titanium, with the balance silicon.

According to this invention, the above results evidenced the suitability of certain Si-Fe-Cr alloys that form oxidation-resistant intermetallic phases when reaction bonded to a niobium-containing material. While specific niobium-base substrate materials were employed during the evaluation of this invention, the invention is generally applicable to niobium-base alloys, intermetallics and composites, and particularly applicable to Nb-Ti-base alloys, intermetallics and composites. Furthermore, while the Si-Fe-Cr coatings of this invention were deposited using an air plasma spray technique, it is foreseeable that other deposition methods could be employed. Finally, though specific Si-Fe-Cr alloy compositions were deposited, this invention encompasses alloys within the disclosed base ranges, as well as alloys having the composition of one of the oxidation-resistant intermetallics and alloys that form one or more of these intermetallics when reaction bonded to a niobium-containing substrate material.

What is claimed is:

1. A process of forming an oxidation-resistant coating on a niobium-base intermetallic material, the processing comprising the steps of:

depositing an Si-Fe-Cr alloy on the niobium-base intermetallic material, the Si-Fe-Cr alloy containing, in weight percent, about 26 to about 32 iron and about 24 to about 30 chromium, with the balance being essentially silicon and incidental impurities; and heat treating the niobium-base intermetallic material at a temperature of about 1250° C. to about 1400° C. so as to yield an oxidation-resistant coating comprising an outer layer and an interaction layer between the outer layer and the niobium-base intermetallic material, the outer layer and the interaction layer each containing at least one oxidation-resistant Si-Fe-Nb-Cr intermetallic phase.

2. A process as recited in claim 1, wherein the Si-Fe-Cr alloy consists essentially of, in weight percent, about 29 iron and about 27 chromium, with the balance being silicon and incidental impurities.

3. A process as recited in claim 1, wherein the Si-Fe-Nb-Cr intermetallic phases of the outer and interaction layers consist essentially of niobium, iron, titanium, chromium, hafnium and silicon.

4. A process as recited in claim 1; wherein one of the Si-Fe-Nb-Cr intermetallic phases consists essentially of, in weight percent, about 24 to about 28 iron, about 34 to about 38 niobium, about 7 to about 11 titanium, about 0.5 to about 4 chromium, and up to about 3 hafnium, with the balance being silicon.

5. A process as recited in claim 1, wherein one of the Si-Fe-Nb-Cr intermetallic phases consists essentially of, in weight percent, about 6 to about 10 iron, about 38 to about 32 niobium, about 20 to about 24 titanium, about 4 to about 8 chromium, and up to about 3 hafnium, with the balance being silicon.

6. A process as recited in claim 1, wherein one of the Si-Fe-Nb-Cr intermetallic phases consists essentially of, in weight percent, about 18 to about 22 iron, about 36 to about 40 niobium, about 14 to about 18 titanium, about 2 to about 6 chromium, and up to about 3 hafnium, with the balance being silicon.

7. A process as recited in claim 1, wherein one of the Si-Fe-Nb-Cr intermetallic phases consists essentially of, in weight percent, about 4 to about 8 iron, about 31 to about 35 niobium, about 29 to about 31 titanium, about 5 to about 9 chromium, and up to about 3 hafnium, with the balance being silicon.

8. A process as recited in claim 1, wherein the niobium-base intermetallic material is a Nb-Ti-base silicide intermetallic composite material.

9. The coating formed by the process recited in claim 1.

10. An oxidation-resistant coating on a niobium-base intermetallic material, the oxidation-resistant coating containing at least one oxidation-resistant Si-Fe-Nb-Cr intermetallic phase chosen from the group consisting of, in nominal atomic percent, Si-23.7Fe-23.1 Nb-9.0Ti-1.5Cr-0.5Hf, Si-24.1Ti-21.9Nb-6.8Fe-6.4Cr-0.7Hf, Si-20.7Nb-18.2Fe-16.6Ti-3.7Cr-0.4Hf, and Si-31.5Ti-18.1Nb-6.7Cr-5.0Fe-0.5Hf.

11. A process of forming an oxidation-resistant coating on a niobium-base alloy, the processing comprising the steps of:

depositing an Si-Fe-Cr-Al alloy on the niobium-base alloy; and heat treating the niobium-base alloy at a temperature of about 1200° C. to about 1350° C. so as to yield an oxidation-resistant coating comprising an interaction layer adjacent the niobium-base alloy and an outer layer overlying the interaction layer, the interaction layer containing at least one oxidation-resistant Si-Fe-Nb-Cr intermetallic phase.

12. A process as recited in claim 11, further comprising the step of removing the outer layer so as to expose the interaction layer.

13. A process as recited in claim 12, wherein the removing step entails spallation of the outer layer during the heat treating step.

14. A process as recited in claim 12, wherein the removing step entails removal of the outer layer following the heat treating step.

15. A process as recited in claim 11, wherein the Si-Fe-Cr-Al alloy consists essentially of, in weight percent, about 16 to about 25 percent iron, about 16 to about 24 percent chromium, and about 7 to about 20 percent aluminum, with the balance being silicon and incidental impurities.

16. A process as recited in claim 11, wherein the Si-Fe-Nb-Cr intermetallic phase consists essentially of, in weight percent, about 15 to about 19 iron, about 27 to about 31 niobium, about 18 to about 22 titanium, and about 9 to about 13 chromium, with the balance being silicon and incidental impurities.

17. A process as recited in claim 11, wherein the interaction layer comprises a first layer and a second layer between the first layer and the niobium-base alloy, the first layer being characterized by an (Nb,Ti,Fe)Si intermetallic phase and an (Nb,Ti,Fe,Cr)Si intermetallic phase, and the inner layer being characterized by an (Nb,Ti,Fe,Cr)3Si2 phase.

18. A process as recited in claim 11, wherein the niobium-base alloy is a Nb-Ti-base alloy.

19. The coating formed by the process recited in claim 11.

20. The coating formed by the process recited in claim 12.

* * * * *